US005914166A

United States Patent [19]

Le

[11] Patent Number: 5,914,166

[45] Date of Patent: Jun. 22, 1999

[54] BRA-STRAP SECURING SYSTEM

[76] Inventor: Chi Kim Le, 3211 36th Ave. North, St. Petersberg, Fla. 33713

[21] Appl. No.: 08/963,586

[22] Filed: Nov. 6, 1997

Related U.S. Application Data

[63] Continuation-in-part of application No. 08/691,099, Aug. 1, 1996, abandoned.

[51] Int. Cl.[6] ..... A41C 3/00; A41F 15/02

[52] U.S. Cl. ..... 428/40.1; 2/268; 2/459; 2/460; 2/461; 2/462; 428/42.2; 428/42.3; 450/86

[58] Field of Search ..... 428/40.1, 42.2, 428/42.3; 450/86; 2/268, 459, 460, 461, 462

*Primary Examiner*—Nasser Ahmad

[57] ABSTRACT

A new Bra-Strap Securing System for retaining a bra-strap directly underneath a shirt strap of various types of sleeveless shirts preventing the bra-strap from exposure by securing the bra-strap with a middle positioned dual-sided adhesive tape. The inventive device includes a length of dual-sided adhesive tape formed into a tape roll, transparent or colored, which includes a plurality of perforations perpendicularly aligned to the longitudinal length of the dual-sided adhesive tape at various lengths apart allowing the user to remove an ergonomic section when needed from the tape roll, or can be sold in separate pieces in various lengths and widths.

2 Claims, 2 Drawing Sheets

FIG 1
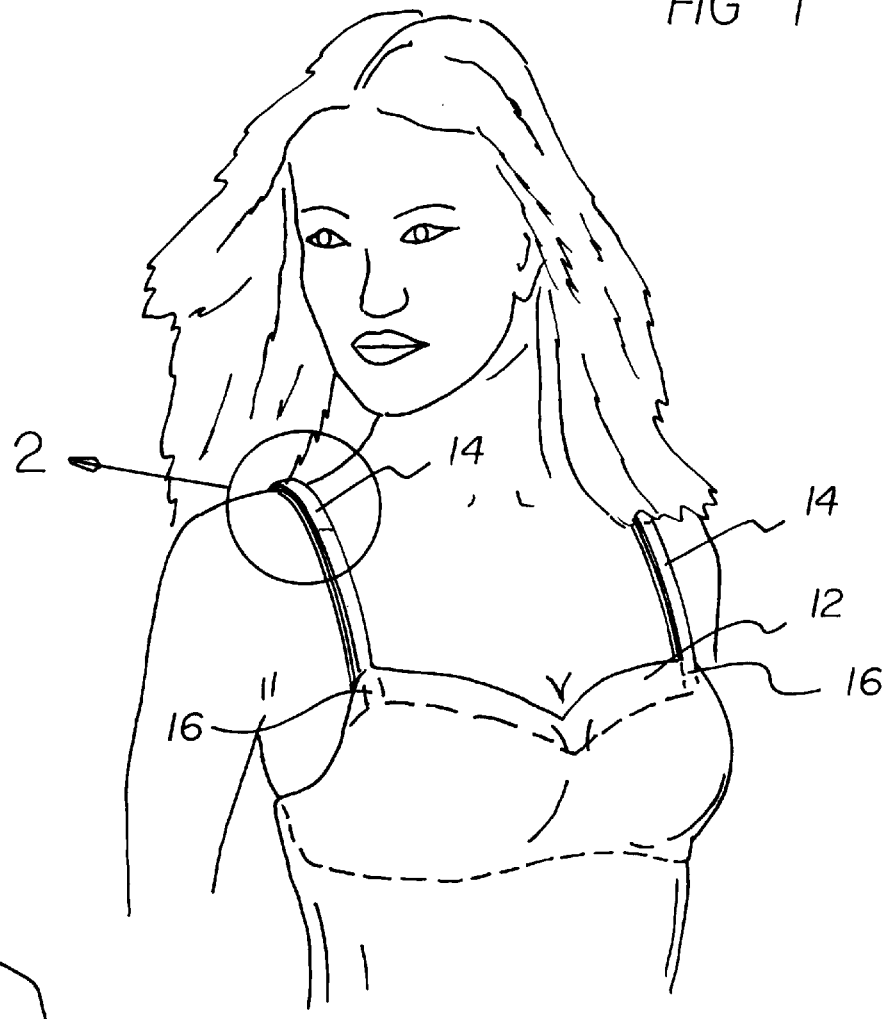
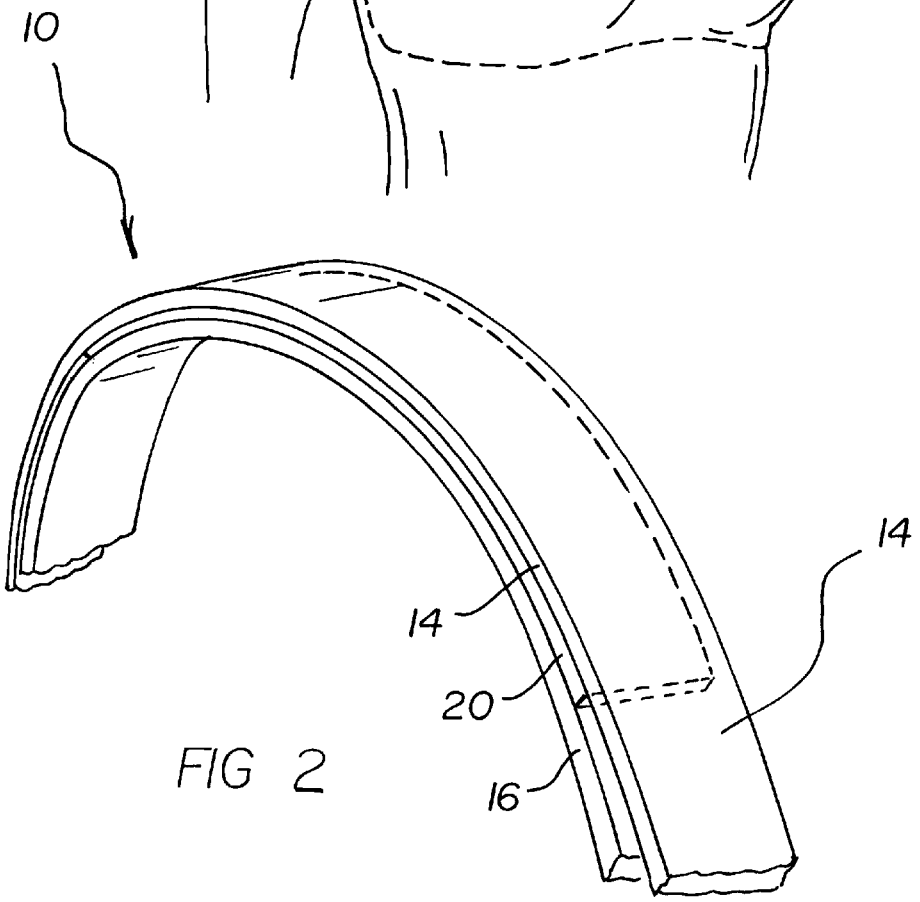
FIG 2

BRA-STRAP SECURING SYSTEM

CROSS REFERENCE TO RELATED APPLICATION

This application is a continuation-in-part of my prior utility patent application Ser. No. 08/691,099, filed Aug. 1, 1996 now abandoned.

BACKGROUND OF THE INVENTION

1. Field of the Invention

The present invention relates to Bra Devices and more particularly pertains to a new Bra-Strap Securing System for retaining a bra-strap directly underneath a shirt strap of various types of sleeveless shirts preventing the bra-strap from exposure by securing the bra-strap with a middle positioned dual-sided adhesive tape.

2. Description of the Prior Art

The use of Bra Devices is known in the prior art. More specifically, Bra Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Bra Devices include U.S. Pat. No. 5,332,607; U.S. Pat. No. 4,582,737; U.S. Pat. No. 4,844,973; U.S. Pat. No. 4,636,427; U.S. Pat. No. 4,522,870; U.S. Pat. No. 2,633,440; U.S. Pat. No. 3,648,835; U.S. Pat. No. 4,842,919; U.S. Pat. No. 5,130,185; and U.S. Pat. No. 5,543,190.

While these devices fulfill their respective, particular objectives and requirements, the aforementioned patents do not disclose a new Bra-Strap Securing System. The inventive device includes a length of dual-sided adhesive tape formed into a tape roll, transparent or colored, which includes a plurality of perforations perpendicularly aligned to the longitudinal length of the dual-sided adhesive tape at various lengths apart allowing the user to remove an ergonomic section when needed from the tape roll.

In these respects, the Bra-Strap Securing System according to the present invention substantially departs from the conventional concepts and designs of the prior art, and in so doing provides an apparatus primarily developed for the purpose of retaining a bra-strap directly underneath a shirt strap of various types of sleeveless shirts preventing the bra-strap from exposure by securing the bra-strap with a middle positioned dual-sided adhesive tape.

SUMMARY OF THE INVENTION

In view of the foregoing disadvantages inherent in the known types of Bra Devices now present in the prior art, the present invention provides a new Bra-Strap Securing System construction wherein the same can be utilized for retaining a bra-strap directly underneath a shirt strap of various types of sleeveless shirts preventing the bra-strap from exposure by securing the bra-strap with a middle positioned dual-sided adhesive tape.

The general purpose of the present invention, which will be described subsequently in greater detail, is to provide a new Bra-Strap Securing System apparatus and method which has many of the advantages of the Bra Devices mentioned heretofore and many novel features that result in a new Bra-Strap Securing System which is not anticipated, rendered obvious, suggested, or even implied by any of the prior art Bra Devices, either alone or in any combination thereof.

To attain this, the present invention generally comprises a length of dual-sided adhesive tape formed into a tape roll, transparent or colored, which includes a plurality of perforations perpendicularly aligned to the longitudinal length of the dual-sided adhesive tape at various lengths apart allowing the user to remove an ergonomic section when needed from the tape roll.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Bra-Strap Securing System apparatus and method which has many of the advantages of the Bra Devices mentioned heretofore and many novel features that result in a new Bra-Strap Securing System which is not anticipated, rendered obvious, suggested, or even implied by any of the prior art Bra Devices, either alone or in any combination thereof.

It is another object of the present invention to provide a new Bra-Strap Securing System which may be easily and efficiently manufactured and marketed.

It is a further object of the present invention to provide a new Bra-Strap Securing System which is of a durable and reliable construction.

An even further object of the present invention is to provide a new Bra-Strap Securing System which is susceptible of a low cost of manufacture with regard to both materials and labor, and which accordingly is then susceptible of low prices of sale to the consuming public, thereby making such Bra-Strap Securing System economically available to the buying public.

Still yet another object of the present invention is to provide a new Bra-Strap Securing System which provides in the apparatuses and methods of the prior art some of the advantages thereof, while simultaneously overcoming some of the disadvantages normally associated therewith.

Still another object of the present invention is to provide a new Bra-Strap Securing System for retaining a bra-strap directly underneath a shirt strap of various types of sleeveless shirts preventing the bra-strap from exposure by securing the bra-strap with a middle positioned dual-sided adhesive tape.

Yet another object of the present invention is to provide a new Bra-Strap Securing System which includes a length of dual-sided adhesive tape formed into a tape roll, transparent or colored, which includes a plurality of perforations perpendicularly aligned to the longitudinal length of the dual-sided adhesive tape at various lengths apart allowing the user to remove an ergonomic section when needed from the tape roll.

Still yet another object of the present invention is to provide a new Bra-Strap Securing System that prevents the bra-strap from showing when wearing various types of sleeveless shirts.

Even still another object of the present invention is to provide a new Bra-Strap Securing System that prevents the user from constantly having to adjust the bra-strap when it is exposed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side perspective view of a new Bra-Strap Securing System positioned between a shirt strap and a bra-strap according to the present invention.

FIG. 2 is a magnified view of the centrally positioned dual-sided adhesive tape from FIG. 1.

DESCRIPTION OF THE PREFERRED EMBODIMENT

Figure 3:
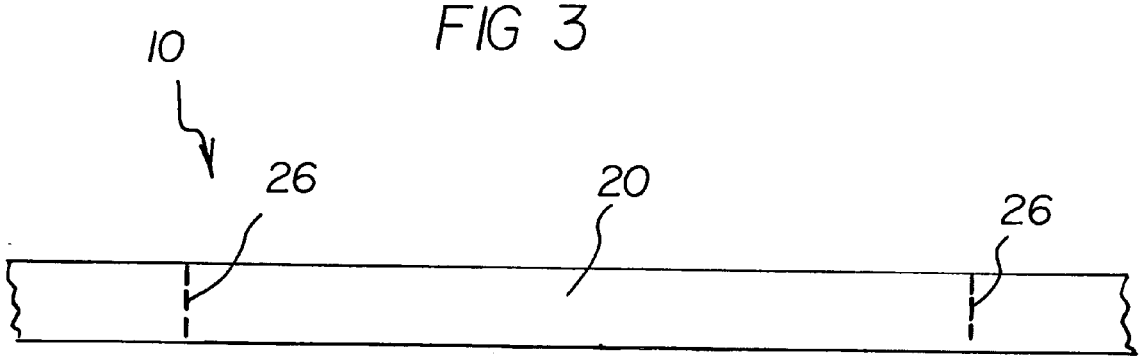
FIG. 3 is a top view of the present invention disclosing the spaced perforations within the dual-sided adhesive tape.
Figure 4:
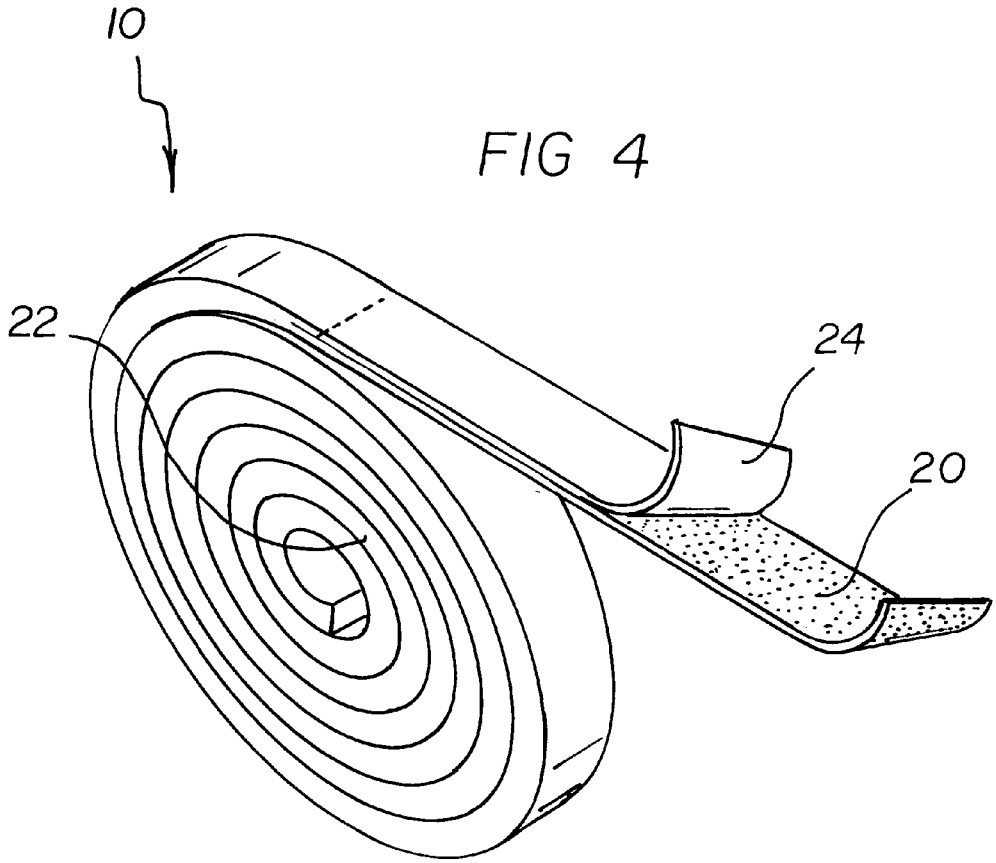
FIG. 4 is a side perspective view of a tape roll containing the dual-sided tape.

With reference now to the drawings, and in particular to FIGS. 1 through 4 thereof, a new Bra-Strap Securing System embodying the principles and concepts of the present invention and generally designated by the reference numeral 10 will be described.

More specifically, it will be noted that the Bra-Strap Securing System 10 comprises a length of dual-sided adhesive tape 20 mesially positioned and securing a shirt strap 14 of a sleeveless shirt 12 and a bra-strap 16 thereby preventing said bra-strap 16 from being exposed, and a corresponding length of tape strip cover 24 removably secured to the top surface of the dual-sided adhesive tape 20 allowing said dual-sided adhesive tape 20 to be wound into a tape roll 22 for dispensing.

As best illustrated in FIGS. 1 through 4, it can be shown that the dual-sided adhesive tape 20 includes a series of perforations 26 aligned perpendicularly to the longitudinal length of said dual-sided adhesive tape 20 allowing removal of a desired length of the dual-sided adhesive tape 20. The dual-sided adhesive tape 20 is preferably ergonomically formed to the shape of a woman's upper shoulder portion and the width is equal to one-quarter of an inch, and constructed from a material which is nontoxic and is non-reactive with the user's skin during perspiration. The dual-sided adhesive tape 20 is preferably transparent. In an alternative embodiment, the dual-sided adhesive tape 20 is colored thereby matching the color of the shirt strap 14.

In use, the user removes the desired length of dual-sided adhesive tape 20 by tearing at a specified perforation 26. The user then removes the tape strip cover 24 from the length of dual-sided adhesive tape 20. The length of dual-sided adhesive tape 20 is positioned between and juxtaposed the shirt strap 14 and the bra-strap 16 thereby preventing said bra-strap 16 from becoming exposed during utilization of the unnumbered bra. When finished, the user simply removes the dual-sided adhesive tape 20 from between the bra-strap 16 and the shirt strap 14 where it can disposed of or stored for reuse.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Bra-Strap Securing System comprising:

a bra having a pair of shoulder straps each extending over the upper portion of a shoulder of the wearer of the bra;

a sleeveless shirt having a pair of shoulder strap portions each extending over a said bra shoulder strap and the upper portion of a shoulder of the wearer of the sleeveless shirt; and a pair of lengths of dual-sided adhesive tape each having opposite sides, each length of dual-sided adhesive tape being positioned between a shoulder strap of said bra and a shoulder strap portion of said sleeveless shirt, and each said length of dual-sided adhesive tape being adhesively secured on one said side of said length to said bra strap and on the opposite said side of said length to said shirt shoulder strap portion such that movement of said shoulder strap from under said shoulder portion is prevented.

2. A system for using a dual sided adhesive tape to secure a bra strap beneath a sleeveless shirt, said method comprising the steps of:

putting on a bra having a pair of shoulder straps with each shoulder strap extending over the upper portion of a shoulder of the wearer of the bra;

providing two strips of dual-sided adhesive tape each having opposite first and second sides;

adhering the first side of each strip of dual-sided adhesive tape on the shoulder strap near the top of the shoulder of the wearer in a position opposite the skin of the bra wearer;

putting on a sleeveless shirt having a pair of shoulder strap portions each extending over a shoulder strap of said bra, and adhering the shoulder strap portions of the sleeveless shirt to the second side of each strip of dual-sided adhesive tape by pressing the shoulder strap portions onto the second side so that the dual-sided adhesive tape is sandwiched between the shoulder strap of said bra and the shoulder strap portion of said sleeveless shirt so that said shoulder strap is prevented from moving away from said shoulder strap portion.

* * * * *